US011014787B2

(12) United States Patent
Tamaki

(10) Patent No.: US 11,014,787 B2
(45) Date of Patent: May 25, 2021

(54) PASSENGER CONVEYOR BALUSTRADE APPARATUS AND LIGHTING HOLDER

(71) Applicant: Mitsubishi Electric Corporation, Tokyo (JP)

(72) Inventor: Keita Tamaki, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/603,246

(22) PCT Filed: Jun. 2, 2017

(86) PCT No.: PCT/JP2017/020677
§ 371 (c)(1),
(2) Date: Oct. 7, 2019

(87) PCT Pub. No.: WO2018/220843
PCT Pub. Date: Dec. 6, 2018

(65) Prior Publication Data

US 2021/0078833 A1 Mar. 18, 2021

(51) Int. Cl.
*B66B 29/08* (2006.01)
*B66B 23/22* (2006.01)

(52) U.S. Cl.
CPC ..... *B66B 23/225* (2013.01)

(58) Field of Classification Search
CPC ..... B66B 23/22; B66B 23/24; B66B 23/225; B66B 23/26; B66B 29/08; B66B 21/02
USPC ..... 198/335, 336, 337, 338
See application file for complete search history.

(56) References Cited

U.S. PATENT DOCUMENTS 4,798,274 A * 1/1989 Saito ..... B66B 23/225 198/324
4,871,056 A * 10/1989 Saito ..... B66B 23/225 198/335
5,040,659 A * 8/1991 Saito ..... B66B 29/04 198/324
5,067,062 A * 11/1991 Rulke ..... B66B 23/22 362/146

(Continued)

FOREIGN PATENT DOCUMENTS

DE 297 21 267 U1 1/1998
EP 0960847 A1 12/1999

(Continued)

OTHER PUBLICATIONS

Chinese Office Action dated May 27, 2020 in Chinese Application No. 201780091291.1.

(Continued)

*Primary Examiner* — Joseph A Dillon, Jr.
(74) *Attorney, Agent, or Firm* — Xsensus LLP

(57) ABSTRACT

In a passenger conveyor balustrade apparatus, a lighting box includes: a ceiling portion; and a pair of side surface portions that protrude downward from the ceiling portion so as to face each other, an opening being disposed on a lower portion of the lighting box. A lighting holder that holds a lighting appliance is mounted inside the lighting box. The lighting holder has an elastically deforming portion. The lighting holder is held inside the lighting box by being pressed against the pair of side surface portions by elastically deforming the elastically deforming portion.

10 Claims, 4 Drawing Sheets

(56) References Cited

U.S. PATENT DOCUMENTS 5,339,228 A * 8/1994 Baethge ..... B66B 23/22 362/146
5,511,647 A * 4/1996 Adrian ..... B66B 31/00 198/335
10,160,622 B2 * 12/2018 Kim ..... A61L 2/10
10,259,685 B2 * 4/2019 Fuchs ..... B66B 21/04
2002/0036121 A1 * 3/2002 Ball ..... B66B 23/24 187/391
2004/0257800 A1 * 12/2004 Kleewein ..... B66B 23/225 362/146
2009/0067162 A1 * 3/2009 Vogt ..... B66B 23/22 362/146
2011/0042179 A1 * 2/2011 Vogt ..... B01J 23/08 198/326
2011/0096535 A1 * 4/2011 Pfeiler ..... B66B 23/225 362/146
2012/0175220 A1 * 7/2012 Masanori ..... F21V 33/0076 198/322
2012/0236547 A1 * 9/2012 Hartman ..... B66B 23/225 362/152
2013/0279201 A1 * 10/2013 Matheisl ..... G02B 6/0011 362/615
2019/0270616 A1 * 9/2019 Kikuchi ..... B66B 23/24
2020/0384141 A1 * 12/2020 Kim ..... A61L 2/26

FOREIGN PATENT DOCUMENTS

JP 2011-116498 A 6/2011
JP 5447886 B2 3/2014
JP 5773862 B2 9/2015
JP 2016-222436 A 12/2016

OTHER PUBLICATIONS

International Search Report and Written Opinion dated Aug. 22, 2017 for PCT/JP2017/020677 filed on Jun. 2, 2017, 9 pages including English Translation of the International Search Report.

* cited by examiner

PASSENGER CONVEYOR BALUSTRADE APPARATUS AND LIGHTING HOLDER

CROSS-REFERENCE TO RELATED APPLICATION

The present application is based on PCT filing PCT/JP2017/020677, filed Jun. 2, 2017, the entire contents of which are incorporated herein by reference.

TECHNICAL FIELD

The present invention relates to a passenger conveyor balustrade apparatus on which a lighting appliance is disposed, and to a lighting holder that holds the lighting appliance inside a lighting box of the balustrade apparatus.

BACKGROUND ART

In conventional escalator lighting apparatuses, long LED units are installed on rectilinear portions of railings by means of rectilinear portion mounting plates. A plurality of short LED units are installed on curved portions of the railings by means of curved portion mounting plates. The curved portion mounting plates are pressed against upper portions of lighting boxes by a plurality of plate springs. Two end portions of each of the plate springs are hooked onto a pair of leg portions of the lighting boxes (see Patent Literature 1, for example).

CITATION LIST

Patent Literature

[Patent Literature 1]
Japanese Patent Laid-Open No. 2011-116498 (Gazette)

SUMMARY OF THE INVENTION

Problem to be Solved by the Invention

Generally, in passenger conveyor balustrade apparatuses, it is difficult to install holders that hold lighting appliances on guard rails at the installation site. Because of that, the holders are delivered to the installation site in a state of being mounted to the guard rails in advance at the manufacturing stage.

On the other hand, since the lighting appliances are mounted at the installation site, a need arises to account for manufacturing errors in respective parts and overall sagging of the passenger conveyor at the installation site. Because of that, design is required to be performed so as to provide tolerances in advance, increasing the study burden in the design stage. Furthermore, if errors at the installation site are unexpectedly large and cannot be accounted for, large-scale on-site remodeling or parts replacement may be required.

In answer to this, in the lighting apparatus that is disclosed in Patent Literature 1, the plate springs and the curved portion mounting plates can be mounted inside the lighting boxes at the installation site. However, since two ends of the curved portions of the lighting apparatuses are fixed to the rectilinear portions of the lighting apparatuses, positions of the curved portions cannot be adjusted separately. Furthermore, an operation for fixing the rectilinear portions arises, increasing the number of operations. In addition, the operation is complicated since it is necessary to hold the curved portion mounting plates inside the lighting boxes while inserting the plate springs inside the lighting boxes to press the curved portion mounting plates against the lighting boxes using the plate springs.

The present invention aims to solve the above problems and an object of the present invention is to provide a passenger conveyor balustrade apparatus and lighting holder that enable position adjustment of lighting appliances to be performed easily at an installation site.

Means for Solving the Problem

A passenger conveyor balustrade apparatus according to the present invention includes: a lighting box that includes: a ceiling portion; and a pair of side surface portions that protrude downward from the ceiling portion so as to face each other, an opening being disposed on a lower portion of the lighting box; a lighting holder that is mounted inside the lighting box; and a lighting appliance that is held by the lighting holder, wherein: the lighting holder has an elastically deforming portion, the lighting holder being held inside the lighting box by being pressed against the pair of side surface portions by elastically deforming the elastically deforming portion.

A passenger conveyor lighting holder according to the present invention includes: a mounting portion that is mounted inside a lighting box on which a pair of side surface portions that face each other are disposed; and a holding portion that is disposed on the mounting portion, the holding portion holding a lighting appliance, wherein: the mounting portion has an elastically deforming portion, the mounting portion being held inside the lighting box by being pressed against the pair of side surface portions by elastically deforming the elastically deforming portion.

Effects of the Invention

The passenger conveyor balustrade apparatus and lighting holder according to the present invention enable positional adjustment of the lighting appliance to be performed easily at the installation site.

DESCRIPTION OF EMBODIMENTS

An embodiment for implementing the present invention will now be explained with reference to the drawings.

Embodiment 1

Figure 1:
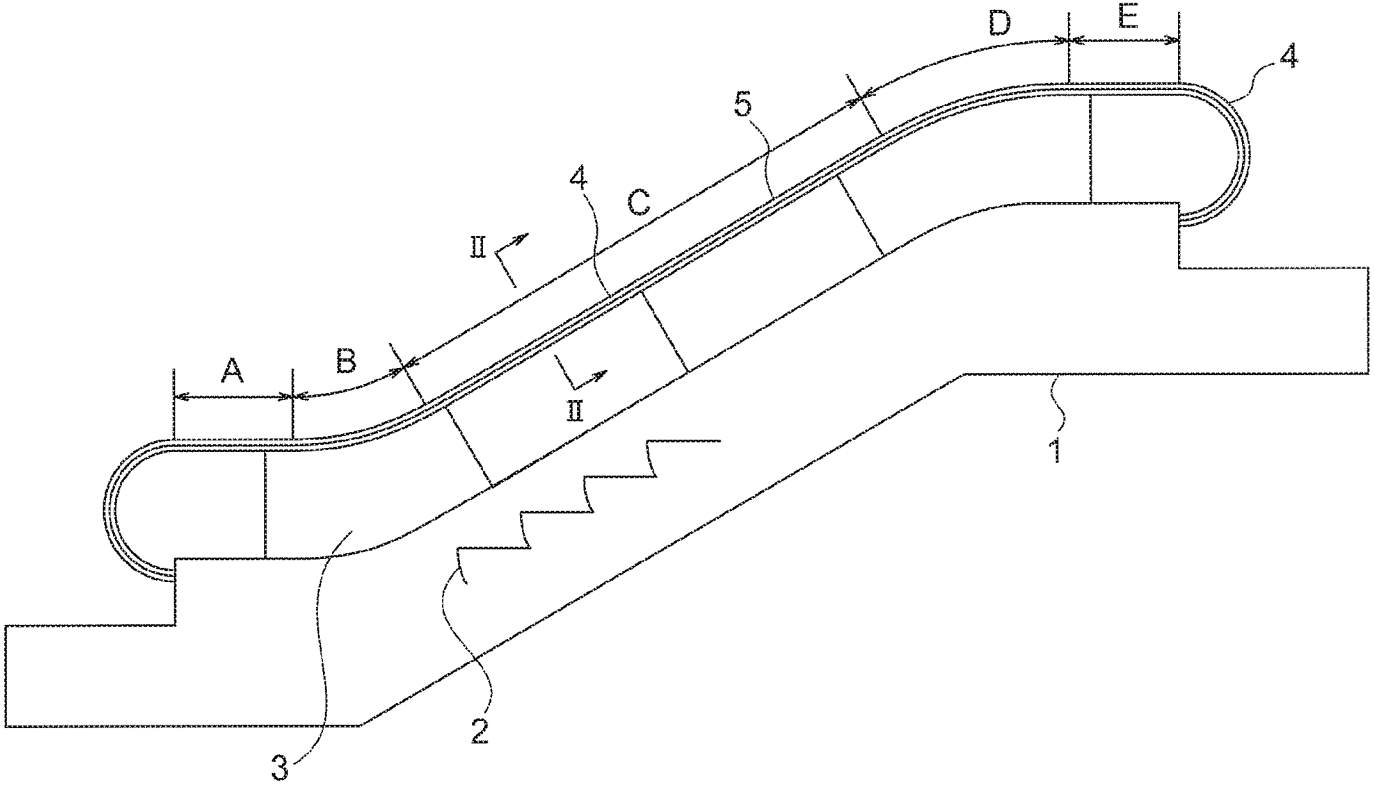
FIG. 1 is a schematic configuration diagram that shows an escalator according to Embodiment 1 of the present invention.

FIG. 1 is a schematic configuration diagram that shows an escalator according to Embodiment 1 of the present invention. In FIG. 1, a truss 1 is disposed so as to span between building beams of upper and lower floors. A plurality of steps 2 (only a portion shown) that are linked endlessly are supported by the truss 1. The steps 2 move cyclically so as to be guided by a plurality of rails (not shown) that are installed inside the truss 1.

A pair of balustrade apparatuses 3 are erected on the truss 1 on two sides of the steps 2. An endless moving handrail 4 that is moved cyclically synchronously with the steps 2 is disposed on each of the balustrade apparatuses 3. The moving handrails 4 move along the balustrade apparatuses 3 on their forward path. The moving handrails 4 are turned around at a newel portion at a first end portion of the balustrade apparatuses 3, move inside the truss 1, and are led out from a second end portion of the balustrade apparatuses 3.

The forward path sections of the movement pathways of the moving handrails 4 have: a lower horizontal portion A, a lower curved portion B, an intermediate inclined portion C, an upper curved portion D, and an upper horizontal portion E. The lower horizontal portion A, the intermediate inclined portion C, and the upper horizontal portion E are rectilinear sections, and the lower curved portion B and the upper curved portion D are curved sections.

Figure 2:
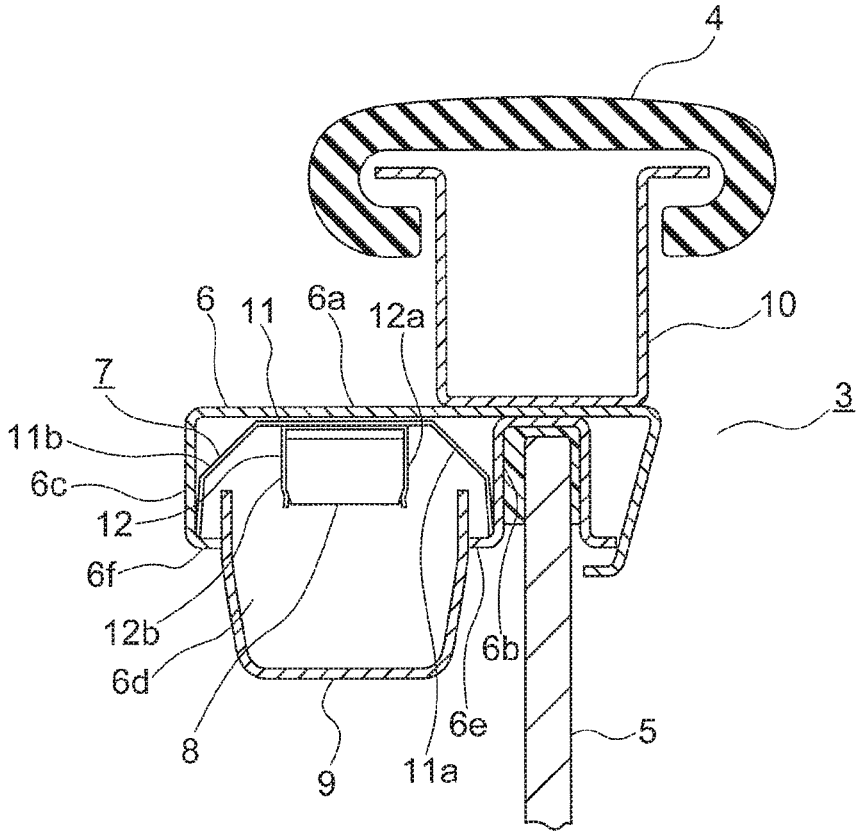
FIG. 2 is a cross section that is taken along Line II-II in FIG. 1.

FIG. 2 is a cross section that is taken along Line II-II in FIG. 1. In the cross section that is shown in FIG. 2, the balustrade apparatus 3 has: an inner plate 5, a lighting box 6, a lighting holder 7, a lighting appliance 8, a lighting cover 9, and a handrail guide 10.

The lighting box 6 is fixed to an upper end portion of the inner plate 5. The lighting box 6 is disposed continuously alongside the forward path section of the movement pathway of the moving handrail 4. In addition, the lighting box 6 has: a horizontal ceiling portion 6*a*; and a pair of side surface portions 6*b* and 6*c* that face each other. The side surface portions 6*b* and 6*c* protrude downward from the ceiling portion 6*a*.

An opening 6*d* is disposed on a lower portion of the lighting box 6. The opening 6*d* is disposed continuously alongside the forward path section of the moving handrail 4. A pair of protruding portions 6*e* and 6*f* that protrude inward are disposed on lower end portions of the side surface portions 6*b* and 6*c*. The protruding portions 6*e* and 6*f* constitute edge portions on two sides in a width direction of the opening 6*d*.

The lighting holder 7 is mounted inside the lighting box 6. The lighting appliance 8 is held by the lighting holder 7. The lighting appliance 8 is illuminated by electric power that is supplied from an electric power supply that is installed in a machine room (not shown). A light-emitting diode (LED) unit that has a plurality of LED elements is used as the lighting appliance 8, for example.

Two or more lighting appliances 8 are disposed inside the lighting box 6 when the whole balustrade apparatus 3 is viewed. The lighting appliances 8 are disposed so as to line up in the direction of movement of the moving handrail 4. The respective lighting appliances 8 are held by two or more lighting holders 7.

The lighting cover 9 is mounted to the lighting box 6 so as to cover the opening 6*d*. The lighting cover 9 is constructed using an optically transparent resin. A cross-sectional shape of the lighting cover 9 is a U shape. An upper end portion of the lighting cover 9 is fitted into the opening 6*d*. A lower end portion of the lighting cover 9 is positioned opposite the lighting appliance 8.

The handrail guide 10 is disposed directly above the inner plate 5, and is fixed onto the lighting box 6. The moving handrail 4 is placed over the handrail guide 10, and moves so as to be guided by the handrail guide 10.

Figure 3:
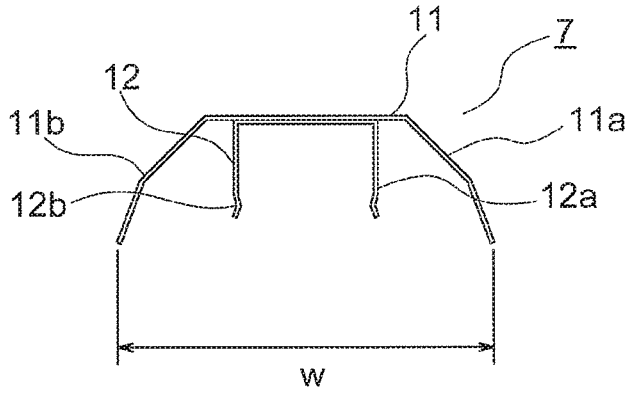
FIG. 3 is a front elevation that shows a state before mounting a lighting holder from FIG. 2 to a lighting box.
Figure 4:
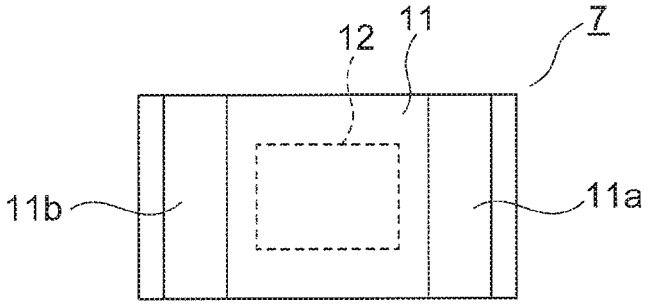
FIG. 4 is a plan that shows the lighting holder from FIG. 3.

FIG. 3 is a front elevation that shows a state before mounting the lighting holder 7 from FIG. 2 to the lighting box 6, and FIG. 4 is a plan that shows the lighting holder 7 from FIG. 3. The lighting holder 7 has: a mounting portion 11 that is mounted inside the lighting box 6; and a holding portion 12 that is fixed to a lower surface of the mounting portion 11. The holding portion 12 is welded, glued, or screwed to the mounting portion 11.

The lighting appliance 8 is held by the holding portion 12. The holding portion 12 has a pair of arms 12*a* and 12*b* that grip the lighting appliance 8.

The mounting portion 11 is constructed using a material that can be elastically deformed, such as a metal sheet, for example. The mounting portion 11 has a pair of plate spring portions 11*a* and 11*b* that function as an elastically deforming portion. The plate spring portions 11*a* and 11*b* are disposed symmetrically to the left and right on two sides of the lighting appliance 8, i.e., on two sides of the holding portion 12.

In a state in which the lighting holder 7 is mounted to the lighting box 6, the pair of plate spring portions 11*a* and 11*b* are respectively pressed against the corresponding side surface portions 6*b* and 6*c*. In other words, the mounting portion 11 is held inside the lighting box 6 so as to be pressed against the pair of side surface portions 6*b* and 6*c* by elastically deforming the plate spring portions 11*a* and 11*b*.

Where a width direction of the lighting box 6 and the lighting holder 7 is a direction that is parallel to a width direction of the moving handrail 4 (left-right in FIG. 2), an overall width dimension of the lighting holder 7 is similar or identical to a width dimension of the mounting portion 11. A width dimension W of the mounting portion 11 before mounting to the lighting box 6 is greater than a distance between the pair of side surface portions 6*b* and 6*c*.

Because of this, the width dimension of the mounting portion 11 is reduced by mounting the mounting portion 11 to the lighting box 6. The lighting holder 7 is held inside the lighting box 6 by the resultant force of recovery of the plate spring portions 11*a* and 11*b*.

Where a longitudinal direction of the lighting box 6 is a direction that is parallel to a longitudinal direction of the moving handrail 4, and a direction of illumination of the light from the lighting appliance 8 is a direction that is perpendicular to the longitudinal direction and the width direction of the lighting box 6, i.e., a vertical direction, a vertical dimension of the lighting holder 7 is less than a distance from the ceiling portion 6*a* to the opening 6*d* when a cross section that is perpendicular to the longitudinal direction of the lighting box 6 is viewed in a state in which the lighting holder 7 is mounted into the lighting box 6.

In addition, a longitudinal dimension of the lighting holder 7 is less than the width dimension of the lighting holder 7.

In a balustrade apparatus 3 and a lighting holder 7 of this kind, because the mounting portion 11 is mounted into the lighting box 6 by spring forces from the plate spring portions 11*a* and 11*b*, positional adjustment of the lighting appliance 8 can be performed easily at the installation site. Because of that, it is not necessary to consider the position of the lighting holder 7 in the longitudinal direction of the lighting box 6 at the design stage, enabling the study burden in the design stage to be reduced, and also enabling design freedom to be improved.

Furthermore, even if the lighting appliance 8 is changed, e.g., changed from a fluorescent lamp to a light-emitting diode (LED) unit, for example, the plate spring portions 11*a* and 11*b* can be placed in contact with the side surface portions 6*b* and 6*c* in a similar or identical manner to when newly installed, by adjusting the width dimension W by modifying material dimensions or bending angles, etc., of the plate spring portions 11*a* and 11*b* relative to an existing lighting box 6, enabling the lighting holder 7 to be installed in any position.

In addition, by making the lighting box 6 and the lighting holder 7 into separate parts, productivity of the lighting box 6 can be improved. Furthermore, standardization of the longitudinal dimensions of the lighting box 6 and reductions in part types can be achieved.

Furthermore, because the pair of plate spring portions 11*a* and 11*b* are used as the elastically deforming portion, the lighting holder 7 can be mounted into the lighting box 6 stably by a simple configuration. The pressing force on the side surface portions 6*b* and 6*c* can also be easily adjusted by modifying the material dimensions or the number of bends, etc., in the plate spring portions 11*a* and 11*b*.

Because the vertical dimension of the lighting holder 7 is less than the distance from the ceiling portion 6*a* to the opening 6*d*, the position of the lighting holder 7 can also be adjusted vertically. The distance from the lighting appliance 8 to the lighting cover 9 can thereby be adjusted to make light and shade on the lighting cover 9 less noticeable.

In addition, since the longitudinal dimension of the lighting holder 7 is less than the width dimension of the lighting holder 7, i.e., the lighting holder 7 is a short part in the direction of travel of the moving handrail 4, a common lighting holder 7 can be applied to both the rectilinear sections and the curved sections of the movement pathway of the moving handrail 4.

Figure 5:
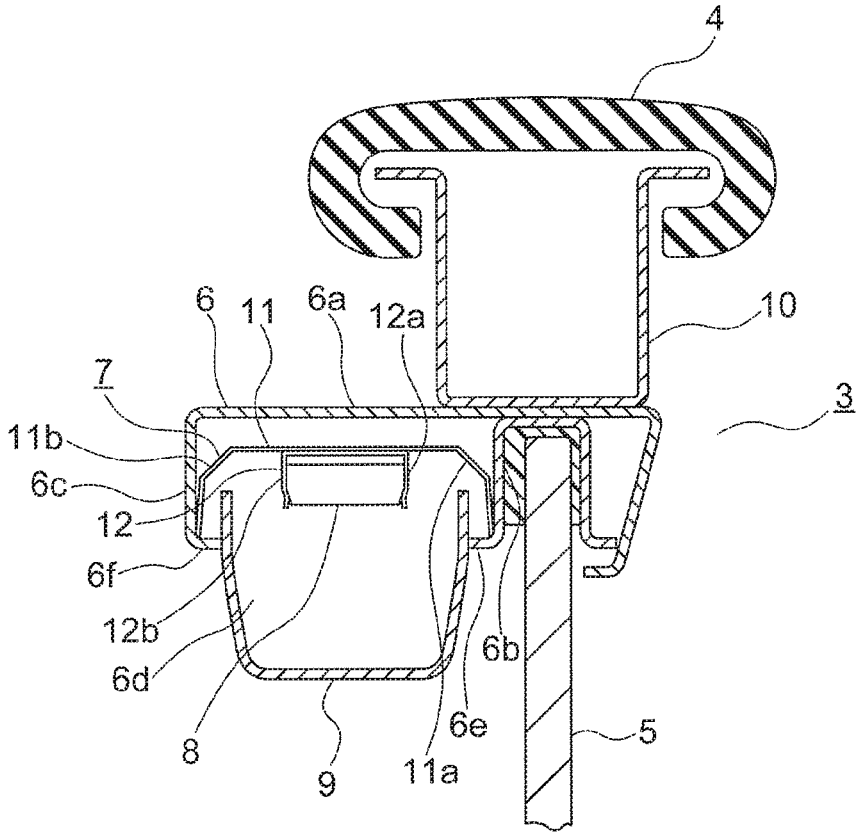
FIG. 5 is a cross section that shows a variation in which vertical dimensions of the lighting holder and a lighting appliance from FIG. 2 are reduced.

Moreover, by making the vertical dimensions of the lighting holder 7 and the lighting appliance 8 even smaller than in FIG. 2, as shown in FIG. 5, for example, the vertical position of the lighting appliance 8 can be displaced significantly between the ceiling portion 6*a* and the opening 6*d*.

The elastically deforming portion is not limited to a plate spring portion, and may alternatively be a helical spring, or a rubber piece that can be elastically deformed, for example.

In addition, the elastically deforming portion may alternatively be disposed in only one width direction of the lighting holder.

Furthermore, the lighting appliance is not limited to an LED unit.

The present invention can also be applied to a balustrade apparatus of a moving walkway.

EXPLANATION OF NUMBERING

3 BALUSTRADE APPARATUS; 6 LIGHTING BOX; 6*a* CEILING PORTION; 6*b*, 6*c* SIDE SURFACE PORTION; 6*d* OPENING; 7 LIGHTING HOLDER; 8 LIGHTING APPLIANCE; 11 MOUNTING PORTION; 11*a*, 11*b* PLATE SPRING PORTION (ELASTICALLY DEFORMING PORTION); 12 HOLDING PORTION.

The invention claimed is:

1. A passenger conveyor balustrade apparatus comprising:

a lighting box that comprises:

a ceiling portion;

a pair of side surface portions that protrude downward from the ceiling portion so as to face each other; and a pair of edge portions corresponding to the pair of side surface portions, both of the edge portions contacting and protruding from the corresponding side surface portion at a discrete angle, an opening being disposed on a lower portion of the lighting box;

a lighting holder that is mounted inside the lighting box; and a lighting appliance that is held by the lighting holder, wherein:

the lighting holder has an elastically deforming portion, the lighting holder being held inside the lighting box by being pressed against the pair of side surface portions by elastically deforming the elastically deforming portion;

a vertical dimension of the lighting holder is less than a distance from the ceiling portion to the edge portions; and a position of the lighting holder that is held inside the lighting box is adjustable vertically at least due to the vertical dimension of the lighting holder being less than the distance from the ceiling portion to the edge portions.

2. The passenger conveyor balustrade apparatus according to claim 1, wherein:

the lighting holder has a pair of plate spring portions that are disposed on two sides of the lighting appliance as the elastically deforming portion; and the pair of plate spring portions are respectively pressed against the corresponding side surface portions.

3. The passenger conveyor balustrade apparatus according to claim 1, wherein a dimension of the lighting holder in a longitudinal direction of the lighting box is less than a width dimension of the lighting holder.

4. A passenger conveyor lighting holder comprising:

a mounting portion that is mounted inside a lighting box on which a ceiling portion and a pair of side surface portions that protrude downward from the ceiling portion and that face each other are disposed, the lighting box including a pair of edge portions corresponding to the pair of side surface portions, both of the edge portions contacting and protruding from the corresponding side surface portion at a discrete angle, an opening being disposed on a lower portion of the lighting box; and a holding portion that is disposed on the mounting portion, the holding portion holding a lighting appliance, the mounting portion having an elastically deforming portion, the mounting portion being held inside the lighting box by being pressed against the pair of side surface portions by elastically deforming the elastically deforming portion, wherein:

a vertical dimension of the lighting holder is less than a distance from the ceiling portion to the edge portions; and a vertical position of the lighting appliance is adjustable when held inside the lighting box at least due to the vertical dimension of the lighting holder being less than the distance from the ceiling portion to the edge portions.

5. The passenger conveyor lighting holder according to claim 4, wherein the mounting portion has a pair of plate spring portions that are disposed on two sides of the holding portion as the elastically deforming portion.

6. The passenger conveyor balustrade apparatus according to claim 2, wherein a dimension of the lighting holder in a longitudinal direction of the lighting box is less than a width dimension of the lighting holder.

7. The passenger conveyor balustrade apparatus according to claim 1, wherein:

the angle at which the edge portions protrude from the corresponding side surface portion is 90 degrees.

8. The passenger conveyor balustrade apparatus according to claim 1, wherein:

the lighting holder includes two vertical portions which contact the side surface portions, a horizontal portion, and two angled portions, each connected to a corresponding one of the vertical portions and the horizontal portion.

9. The passenger conveyor lighting holder according to claim 4, wherein:

the angle at which the edge portions protrude from the corresponding side surface portion is 90 degrees.

10. The passenger conveyor lighting holder according to claim 4, further comprising:

two vertical portions to contact the side surface portions, a horizontal portion, and two angled portions each connected to a corresponding one of the vertical portions and the horizontal portion.

* * * * *